US006052544A

United States Patent [19]

Shimizu et al.

[11] Patent Number: 6,052,544

[45] Date of Patent: Apr. 18, 2000

[54] IMAGE FORMING APPARATUS USING SPECIFIC ELECTRIC FIELD TO TRANSFER STRONTIUM TITANATE-CONTAINING DEVELOPER TO A DRUM

[75] Inventors: Yasushi Shimizu, Toride; Akira Domon, Kashiwa, both of Japan

[73] Assignee: Canon Kabushiki Kaisha, Tokyo, Japan

[21] Appl. No.: 09/170,055

[22] Filed: Oct. 13, 1998

[30] Foreign Application Priority Data

Oct. 13, 1997 [JP] Japan ..... 9-294962

[51] Int. Cl.[7] ..... G03G 15/06

[52] U.S. Cl. ..... 399/55

[58] Field of Search ..... 399/40, 55, 270

[56] References Cited

U.S. PATENT DOCUMENTS 5,066,979 11/1991 Goto et al. ..... 399/40
5,202,731 4/1993 Tanikawa et al. ..... 399/270
5,534,982 7/1996 Sakaizawa et al. ..... 399/270
5,655,191 8/1997 Furuya et al. ..... 399/270 X
5,794,111 8/1998 Tombs et al. ..... 399/302

*Primary Examiner*—Fred L. Braun
*Attorney, Agent, or Firm*—Fitzpatrick, Cella, Harper & Scinto

[57] ABSTRACT

An image forming apparatus includes a photosensitive member and a developer carrying member spaced from the photosensitive member by a gap. The developer carrying member carries a developer containing an externally added strontium titanate. A bias voltage is applied between the photosensitive member and the developer carrying member with a substantially rectangular waveform. This bias voltage forms an oscillating electric field therebetween. The electric field provided by the difference between a jump peak voltage of the bias voltage and the potential of the photosensitive member at a portion exposed to the light is not less than 4.1 V/micron. The electric field provided by a difference between the jump peak voltage and a potential of the photosensitive member at a portion not exposed to light is not more than 3.5 V/micron. The electric field provided by a difference between a returning peak voltage of the bias voltage and a potential of the photosensitive member at a portion not exposed to light is not more than 2.9 V/micron. A ratio of a portion of the voltage for the direction toward the photosensitive member is 20 to 50%.

6 Claims, 9 Drawing Sheets

IMAGE FORMING APPARATUS USING SPECIFIC ELECTRIC FIELD TO TRANSFER STRONTIUM TITANATE-CONTAINING DEVELOPER TO A DRUM

FIELD OF THE INVENTION AND RELATED ART

The present invention relates to an image forming apparatus which employs developer to develop an electrostatic latent image on a photosensitive member. In particular, it relates to an image forming apparatus which employs such developer that is composed of toner, and strontium titanate as an external additive.

Generally, an image forming apparatus for forming images with the use of an electrophotographic process or the like comprises, as illustrated in FIG. 7, an image bearing member 1, a charging apparatus 2 for uniformly charging the image bearing member 1, an exposing apparatus 9 for forming a latent image on the image bearing member 1, a developing apparatus 3 for developing the latent image on the image bearing member 1 into a visible image with the use of toner 7, a transferring apparatus 4 for transferring the toner image, i.e., the developed latent image, onto a sheet of transfer paper 8, a fixing apparatus for fixing the toner image on the transfer sheet 8 to the transfer sheet 8, a cleaning apparatus 5 for cleaning the toner which remains on the image bearing member 1, and the like.

The toner 7 is negatively chargeable magnetic toner, which is composed of a magnetic substance, styrene-acrylic resin, and ferric complex of mono azoic dye (negative charge controller). In manufacturing the toner 7, for example, 100 parts by weight of the magnetic substance, 100 parts by weight of styrene-acrylic resin, and 2 parts by weight of ferric complex of mono azoic dye are kneaded, and pulverized. When this toner 7 is used as developer, silica is externally added to the toner 7 by a ratio of 1.2 parts by weight relative to 100 parts in weight of the toner 7.

In the latent image forming portion of the aforementioned electrophotographic process, the peripheral surface of the image bearing member 1 is uniformly charged by the charging apparatus 2, to a potential level of Vd, i.e., the potential level correspondent to the dark portions. Then, the uniformly charged peripheral surface of the image bearing member 1 is exposed by the exposing apparatus 9, whereby the potential level of the exposed portions of the peripheral surface of the image bearing member 1 becomes a potential level V1, i.e., the potential level correspondent to the light portions. As a result, a latent image is formed on the peripheral surface of the image bearing member 1; the portions with the potential level V1 are formed within the region with the potential level Vd.

In the developing portion of the electrophotographic process, a development sleeve 3*a* which bears the charged toner 7, and the image bearing member 1, are positioned extremely close to each other with a predetermined gap, and development bias composed of predetermined DC voltage and AC voltage is applied between the development sleeve 3*a* and the image bearing member 1, so that the toner 7 is adhered to the light portions with the potential level V1, without being adhered to the dark portions with the potential level Vd. As a result, an image composed of the toner 7 (toner image) is formed on the image bearing member 1.

At this time, the behavior of the toner 7 during the latent image development will be described in detail. When the toner 7 is subjected to friction, most of the toner particles are charged to negative polarity. In other words, the developing portion of the electrophotographic process is set up so that the polarity of the toner 7, the polarity of the dark portion with the potential level Vd on the image bearing member 1, and the polarity of the light portions with the potential level V1, are all rendered negative. Conventionally, development bias used in the developing process in which the relationship between the polarity of the toner and the polarity of the latent image is as described above is such compound bias that is composed of DC voltage with a voltage of Vdc, and AC voltage with a peak-to-peak voltage of Vpp. The wave-form of the AC voltage is rectangular, and the duty ratio of the AC is 50%, as shown in FIG. 8.

Referring to FIG. 8, in the case of this type of development bias, the toner 7 jumps onto the image bearing member 1 from the peripheral surface of the development sleeve 3*a* during the period through which the absolute value of the voltage level V(−) on the negative side is the maximum (peak voltage on the negative side). However, the toner 7 having jumped onto the development sleeve 3*a* is pulled back onto the development sleeve 3*a* from the image bearing member 1 during the period through which the absolute value of the potential level V(+) on the positive side is the maximum (peak voltage on the positive side). The toner 7 is caused to repeat this cycle of jumping and being pulled back while the development bias is applied, and consequentially, adheres to the negatively charged light portions with the potential level V1 of the peripheral surface of the image bearing member 1, because of the following relationship between the toner 7 and the light portions with the potential level V1 of the image bearing member 1 in terms of the potential level:

$$|V(-)-V1|>|V(+)-V1|. \quad (1)$$

However, the toner 7 scarcely adheres to the dark potential Vd portions of the image bearing member 1, because of the following relationship between the toner 7 and the dark potential Vd portions of the image bearing member 1 in terms of the potential level, although the behavior of the toner 7 toward the dark potential Vd portions is the same as the behavior of the toner 7 toward the light potential V1 portions:

$$|V(-)-Vd|<|V(+)-Vd|. \quad (2)$$

In other words, an image can be formed on the image bearing member 1 by the toner 7 by setting the potential levels Vd, V1, V(−), V(+) to satisfy the formulas (1) and (2). In order to satisfy the above described requirements, the difference, that is, the contrast, between the potential levels V(−) and V(+), that is, the peak-to-peak voltage Vpp, is rendered sufficiently large.

One example of such a setting is as follows: V(−)=−1,200 V; V(+)=1,400 V; Vd=−600 V; and V1=−150. The gap between the image bearing member 1 and the development sleeve 3*a* is 280 $\mu$m. FIG. 9 depicts the wave-form of the development bias with the above described settings. The frequency of the development bias is 2,000 Hz (length of ½ cycle of the development bias is 0.25 ms), and the duty ratio is 50%. As described above, referential codes Vd and V1 represent the potential levels of the different portions of the image bearing member 1.

The potential level to which the toner 7 is charged varies depending on the condition of the developing apparatus 3 and/or ambient conditions. Therefore, in order to obtain images with proper density regardless of the change in the potential level of the toner, the potential levels V(−) and V(+) must be adjusted so that proper amount of voltage difference is maintained among the potential levels Vd, V1, V(−), and V(+).

Thus, an arrangement is made to change the potential level of the DC component of the development bias applied between the development sleeve 3*a* and the image bearing member 1 in response to the condition of the developing apparatus and/or the ambient conditions, so that images with proper density can always be produced without changing the potential levels V(−) and V(+).

However, all the toner particles in the toner 7 are not equal in polarity and potential level. In other words, the toner 7 borne on the development sleeve 3*a* contains a certain amount of reversely (positively) charged toner particles, that is, toner particles charged to the polarity opposite to the polarity (negative) to which the majority of the toner particles are charged, as represented by the hatched portion in FIG. 10, which is a graph showing the distribution pattern of the toner particles in terms of polarity and potential level, although the amount of the reversely charged toner particles is very small relative to the amount of the normally charged toner particles.

If the conventional developing system is designed to increase the contrast between the potential levels V1 and V(−) so that sufficient image density is realized, the contrast between the potential levels Vd and V(+) also increases, causing the above described reversely charged toner particles to jump onto the dark potential Vd portions of the image bearing member 1, onto which the normally charged toner particles, that is, the majority of the toner particles, do not jump. In other words, the white portions of an image are contaminated; the so-called "fog" appears on the white portions of an image, decreasing image quality.

Also, in recent years, it has become a common practice to externally add strontium titanate, as a polishing agent, to the toner 7, not only to increase the efficiency with which the toner 7 is charged, but also to polish off the nitrogen oxide which adheres to the image bearing member 1 and causes the image bearing member 1 to be insufficiently charged. However, the addition of strontium titanate has a tendency to increase the amount of the fog caused by the toner 7.

Thus, an effort is made to set the potential levels Vd, V1, V(−), and V(+) so that the fog does not occur. However, in the case of the conventional developing system, latitudes for the potential levels Vd, V1, V(−), and V(+) are rather narrow, and therefore, as the DC component of the development bias is varied to change image density, the balance among the potential levels Vd, V1, V(−), and V(+), which is proper before the DC component is varied, is broken, resulting in the appearance of the fog.

SUMMARY OF THE INVENTION

The primary object of the present invention is to provide an image forming apparatus capable of preventing the reversely charged toner particles from causing the fog.

Another object of the present invention is to provide an image forming apparatus capable of externally adding strontium titanate to the toner.

Another object of the present invention is to provide an image forming apparatus comprising: a photosensitive member; a charging device for charging said photosensitive member; an exposing means for exposing said charged photosensitive member to form an electrostatic latent image on said photosensitive member; and a developing means for developing the electrostatic latent image on said photosensitive member with the use of developer to which strontium titanate has been externally added, said developing means comprising a developer bearing member which is disposed virtually in contact with said photosensitive member, maintaining a predetermined gap from said photosensitive member, and a voltage applying means which applies bias voltage with a substantially rectangular wave-form to said developer bearing member to form an alternating electric field between said photosensitive member and said developer bearing member, wherein the electric field strength between the peak voltage of the development bias, on the side which causes the developer to move toward said image bearing member, and the potential level of the exposed portions of said image bearing member is no less than 4.1 V/μm; the electric field strength between the peak voltage of the development bias, on the side which causes the toner to jump onto the image bearing member, and the potential level of the unexposed portions of the image bearing member is no more than 3.5 V/μm; and the electric field strength between the peak voltage of the development bias, on the side which causes the developer to move toward the developer bearing member, and the potential level of the unexposed portions of the image bearing member is no more than 2.9 V/μm; and wherein the duty ratio of the development bias on the side which causes the developer to jump onto the image bearing member is in a range of 20%–30%.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiment of the present invention will be described in detail with reference to the drawings.

Figure 1:
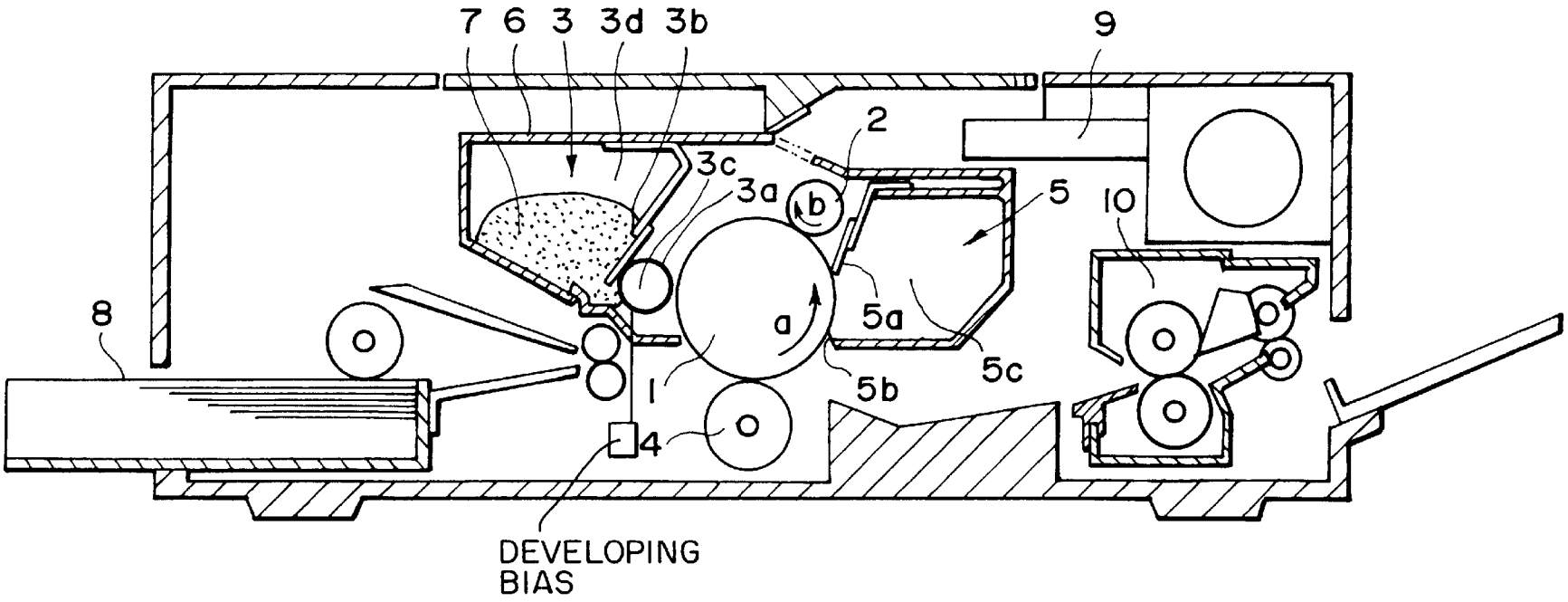
FIG. 1 is a schematic section of the image forming apparatus in an embodiment of the present invention, and depicts the general structure thereof.

FIG. 1 is a schematic section of the image forming apparatus in an embodiment of the present invention, and depicts the general structure thereof. The image forming apparatus in this embodiment is an electrophotographic apparatus.

This image forming apparatus employs a process cartridge which comprises a housing 6, and operational components such as a image bearing member 1, a charge roller (charging apparatus) 2, a developing apparatus 3, and a cleaning apparatus 5, which are integrally and compactly disposed in the housing 6. The image bearing member 1 has a photosensitive layer, and is rotatively driven in the direction indicated by an arrow mark a.

The developing apparatus has a developer container 3*d* which holds the toner 7, a development sleeve 3*a* which conveys the toner 7, and an elastic blade 3*b* which regulates the thickness of the toner 7 coated on the development sleeve 3*a*. Within the development sleeve 3*a*, a magnetic roller 3*c* is disposed. The cleaning apparatus 5 consists of a cleaning container 5*c*, a cleaning member 5*a*, and a squeezer sheet 5*b*.

The charge roller 2 is placed in contact with the image bearing member 1, and rotates in the direction indicated by an arrow mark b, following the rotation of the image bearing member 1 which rotates in the direction a. As the image bearing member 1 is charged by the charge roller 2, a laser beam is projected upon the charged image bearing member 1 from the exposing apparatus 9, whereby an electrostatic latent image is formed on the peripheral surface of the image bearing member 1. The latent image formed on the image bearing member 1 is developed into a toner image, i.e., a visible image, by the developing apparatus which uses the toner 7. Then, the thus obtained toner image is transferred onto a piece of transfer medium by the transfer roller 4. The transfer medium is usually a sheet of recording paper 8. During the transferring of the toner image, a small portion of the toner fails to be transferred onto the recording sheet 8, and this toner which is remaining on the image bearing member is removed by the cleaning member 5*a* of the cleaning apparatus 5, and is collected into the cleaning container 5*c*. The transfer sheet 8 onto which the toner image has been transferred is conveyed to the fixing apparatus 10, and while the recording sheet 8 is passing through the fixing apparatus 10, the toner image is fixed to the transfer sheet 8, ending a single cycle of the image forming process.

In the case of the present invention, strontium titanate is externally added to the toner 7 by no less than 0.5 part in weight. In consideration of the saturation of the effect of the strontium titanate in terms of improvement in toner charging performance, increase in the amount by which the peripheral surface of image bearing member 1 is polished away, cost increase, and the like, the practical upper limit for the ratio by which the strontium titanate is to be added to the toner 7 is 3.0 parts in weight. In this embodiment, the toner 7 is negatively chargeable magnetic toner composed of 100 parts in weight of a magnetic substance, 100 parts in weight of styrene-acrylic resin, and 2 parts in weight of mono azoic dye (negative potential controller). In manufacturing the toner 7, these ingredients are kneaded, and then are pulverized. When the thus produced toner is used as the developer in this embodiment, silica and strontium titanate are externally added to the toner 7 by a ratio of 1.2 parts in weight and 0.5 part in weight, respectively, per 100 parts in weight of the toner 7.

The toner 7 adheres to the development sleeve 3*a* due to the magnetic force of the magnetic roller 3*c*. As the development sleeve 3*a* rotates, the toner 7 adhered to the development sleeve 3*a* is carried to the elastic blade 3*b*, by which the toner 7 is regulated in thickness while being negatively charged. Then, as the development sleeve 3*a* further rotates, the negatively charged toner 7 is conveyed to the development station, in which the peripheral surface of the development sleeve 3*a* squarely faces the peripheral surface of the image bearing member 1, maintaining a predetermined gap.

In this embodiment, the gap (S-D gap) between the development sleeve 3*a* and the image bearing member 1 is always kept at 280 $\mu$m by development roller rings fitted at both longitudinal ends of the development sleeve 3*a*. In developing the latent image, development bias is applied between the development sleeve 3*a* and the image bearing member 1 by a voltage applying means (not shown). In the case of the present invention, this development bias is AC voltage.

Figure 2:
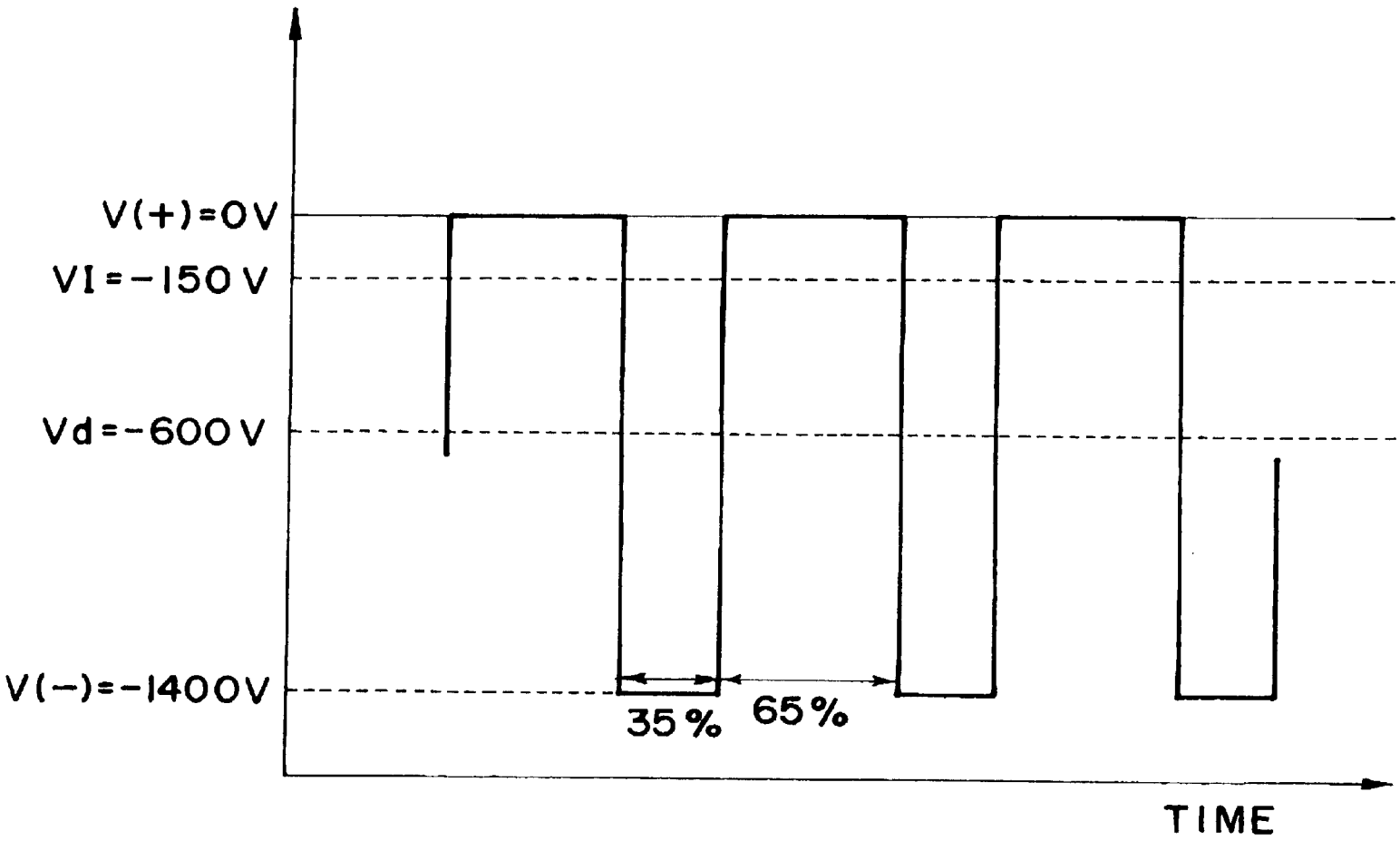
FIG. 2 is a graphic drawing of the wave-form of the development bias employed in the embodiment of the present invention, showing the potential levels Vd and V1 correspondent to the dark and light portions, respectively.

In this embodiment, AC voltage with a rectangular waveform is used, which is shown in FIG. 2. The specifications of this AC voltage are as follows. The value of the peak voltage level V(−) on the negative side which causes the toner 7 to jump onto the image bearing member 1 is −1,400 V:V(−)=−1,400 V. The value of the peak voltage level V(+) on the positive side which causes the toner 7 to be pulled back from the image bearing member 1 onto the development sleeve 3*a* is 0 V: V(+)=0 V. The frequency of the AC voltage is 2,000 Hz. The duty ratio of the rectangular wave-form is 35% in terms of V(−), and 65% in terms of V(+).

The image forming apparatus in this embodiment is designed so that, during the aforementioned latent image forming portion of the electrophotographic process, the potential level Vd, that is, the potential level of the portions of the image bearing member 1, which have been charged by the charge roller 2 but have not been exposed to the latent image forming laser beam, becomes −600 V, and the potential level V1, that is, the potential level of the portions of the image bearing member 1, which have been charged by the charge roller 2 and have been exposed to the latent image forming laser beam, becomes −150 V. With this design in this embodiment, the electric field strength between the peak voltage level V(−) on the side which causes the toner to jump onto the image bearing member 1, and the potential level Vd of the dark portions becomes 2.86 V/$\mu$m, the electric field strength between the peak voltage level V(+) on the side which causes the toner 7 to be pulled back from the image bearing member 1 onto the developing sleeve 3*a*, and the potential level V1 of the light portions, becomes 4.46 V/$\mu$m; and the electric field strength between the potential levels V1 and Vd of the light and dark portions, respectively, becomes 2.14 V/$\mu$m.

One of the characteristics of the present invention is in that the image density is changed only by changing the duty ratio of the development bias by a bias changing means (not shown). The latitude for the change in duty ratio is a range of 20%–50% on the V(−) side. In this embodiment, it is set to be a range of 28%–41%. The image density change caused by the duty ratio change on the V(−) side in the range of 28%–41% is equivalent to the image density change caused in a conventional development system by changing the potential level of the DC component of the development bias in a range of ±150 V.

Figure 3:
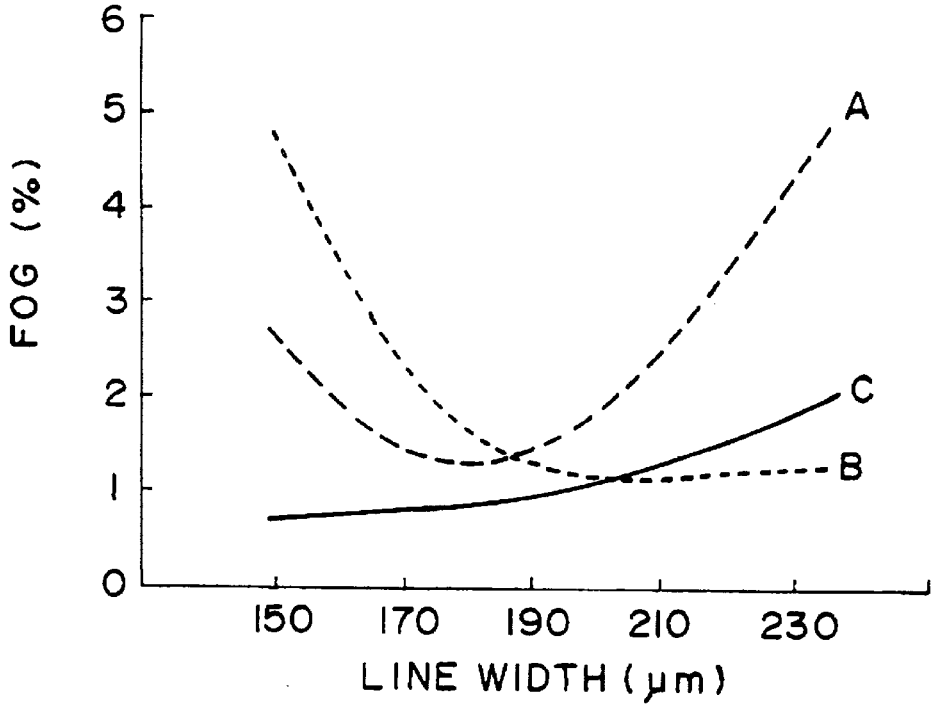
FIG. 3 is a graph which shows the difference between the conventional image density changing system and the image density changing system in accordance with the present invention, in terms of the relationship between the image density and the fog.

FIG. 3 shows the relationship between the image density and the fog in both the image density changing systems in this embodiment and a conventional image density changing system. The image density is plotted as the width of a four dot line in an image with a resolution of 600 dpi, and the fog is plotted as the ratio (%) of the reflection density of a white image formed on a sheet of paper, relative to the reflection density of the sheet of paper prior to the printing of the white image thereon.

In FIG. 3, a dotted line A represents the relationship between the image density and the fog which resulted when the DC value of the development bias was changed in a conventional developing system in which the aforementioned pertinent potential levels on the development sleeve side and the latent image side were set as described above. In this case, the DC value of the development bias was varied in a range of −250 V—550 V, and as the absolute value of the DC component was increased, the line width simply increased. In relation to the change in the line width, this dotted line A, which represented the difference in the reflection density, formed a curvature with a minimum value point.

This was due to the following two phenomenon: a phenomenon that, as the contrast between the potential levels V1 and V(−) was increased to increase the line width in the region where the line was wide, the contrast between the potential levels Vd and V(−) also increased, and therefore, the amount by which the toner jumped onto the dark potential Vd portions increased, and a phenomenon that, on the other hand, in the region where the line was narrow, as the contrast between the potential levels V1 and V(−) was reduced to reduce the line width, the contrast between the potential levels Vd and V(+) also increased, and therefore, the amount by which the reversely charged toner jumped onto the dark potential Vd portions increased.

A dotted line B represents the relationship between the image density and the fog which resulted when the duty ratio of the development bias was changed while the pertinent potential levels on the development bias side and the latent image side were set as in the conventional development system. In this case the duty ratio of the development bias on the V(−) side was changed in the range of 28%–41%, and the line width simply increases as the duty ratio was increased. In relation to the change in the line width, this dotted line B, which represented the difference in the reflection density also formed a curvature with a minimum value point.

This was due to the following reasons. That is, in the region where the line was wide, the length of time the toner was caused to jump, from the development sleeve 3*a* to the image bearing member portions with the potential level V1 by the contrast between the potential levels V1 and V(−), increased as the duty ratio of the development bias, on the V(−) side, was increased, and therefore, the line width increased. In addition, the length of time the toner was caused to jump onto the image bearing member 1 portions with the potential level Vd by the contrast between the potential levels Vd and V(−) also increased, and therefore, the amount by which the toner jumped onto the image bearing member portions with the potential level Vd also increased. However, in the case of the region where the line was wide, the difference between the potential levels Vd and V(−) was not much in terms of the force which causes the toner to jump, and therefore, the amount by which the toner jumped to the image bearing member portions with the potential level Vd did not increase much in spite of the increased length of time.

In comparison, in the region where the line was wide, the line width decreased as the duty ratio on the V(+) side was increased. However, the difference between the potential levels Vd and V(+) was also large enough to cause the reversely charged toner to jump onto the image bearing member portions with the dark potential level Vd, and therefore, the amount by which the reversely charged toner jumped onto the image bearing member portions with the dark potential level Vd drastically increased as the length of time the reversely charged toner was allowed to jump increased.

The solid line C represents the relationship between the image density and the fog which resulted when the duty ratio of the development bias was changed in this embodiment. In this case, as the thickness of the line was increased by changing the duty ratio of the development bias, the aforementioned difference in the reflection density (fog) simply increased, but the amount of the increase was extremely small.

This was due to the following reasons. That is, as the duty ratio on the V(−) side was increased, the length of time the toner was caused to jump from the development sleeve 3*a* onto the image bearing member portions with the potential level V1 by the contrast between the potential levels V1 and V(−) increased, and therefore, the line width increased. In addition, the length of time the toner was caused to jump from the development sleeve 3*a* onto the image bearing member portions with the potential level Vd by the contrast between the potential level Vd and V(−) also increased, and therefore, the amount by which the toner Jumped onto the image bearing member portions with the dark potential level Vd also increased. However, just as in the case represented by the dotted line B, the difference between the potential levels Vd and V(−) was not much in terms of the force which causes the toner to jump, and therefore, the amount of the toner by which the toner jumped onto the image beating member portions with the dark potential level Vd did not increase much in spite of the increase in the length of time allowed for the toner to jump.

On the other hand, as the duty ratio on the V(+) side was increased, the line width decreased. However, the difference between the potential level Vd and V(+) was small enough in terms of the force that causes the reversely charged toner to jump, and therefore, the amount by which the reversely charged toner jumped on the image bearing member portions with the dark potential level Vd scarcely increased in spite of the increase in the length of time allowed for the reversely charged toner to jump.

Therefore, in this embodiment, even when the image density was changed, the amount by which the fog appeared in the white portions of an image scarcely changed. In other words, according to this embodiment, images with fog-free white portions can always be reproduced, even if image density is changed.

At this time, the relationship between the potential levels V(−) and V1, between the potential levels V(−) and Vd, and between the potential levels V(+) and V1, will be described with reference to the studies made to determine proper values for these potential levels.

Figure 4:
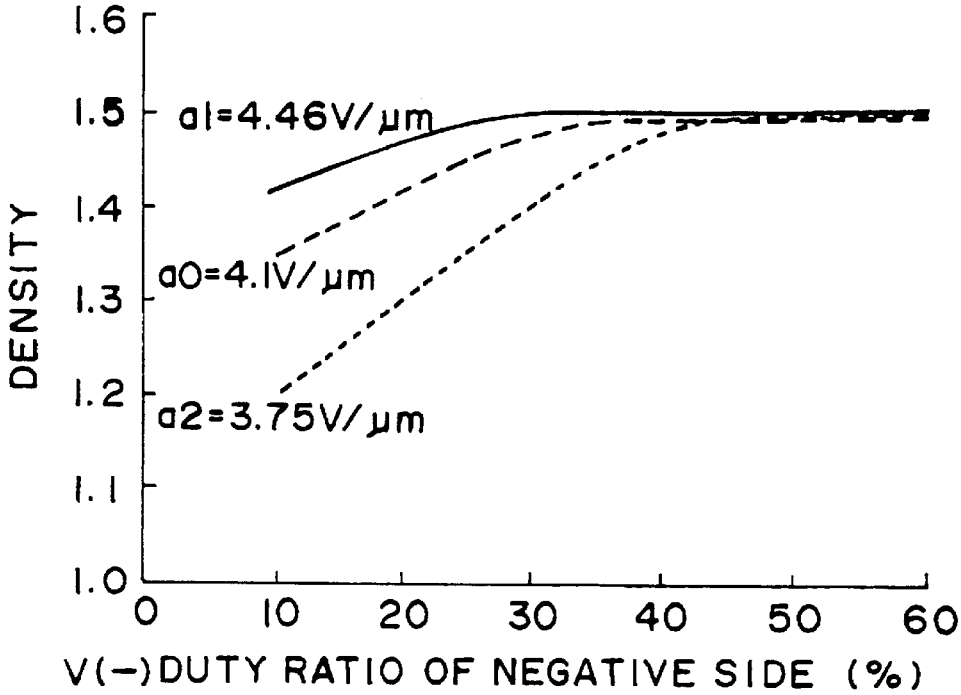
FIG. 4 is a graph which shows the relationship between the image density and the duty ratio of the development bias, on the V(−) side, which resulted when the electric field strength between the potential levels V(−) and V1 was used as the parameter in this embodiment.

In the case of the relationship between the potential levels V(−) and V1, the greater the electric field strength between the potential levels V(−) and V1, the better the reproductivity of the black portions of an image. FIG. 4 shows the relationship between the duty ratio of the development bias on the V(−) side and image density, which resulted when the electric field strength between the potential levels V(−) and V1 was used as a parameter. The three lines in FIG. 4 represent three different electric field strengths: a1=4.46 V/μm (electric field strength in this embodiment); a2=3.75 V/μm (electric field strength in a conventional system: |−150−(−1,200)|/280=3.75); and a0=4.1 V/μm (mid value between a1 and a2). The image density is plotted as the line density of the four dot line in an image with a resolution of 600 dpi.

As is evident from FIG. 4, in order to realize a sufficient amount of line density, that is, a line density of no less than 1.4 while keeping the duty ratio of the development bias, on the V(−) side, in a range of 20%–50%, an electric field strength of no less than 4.1 V/μm is necessary between the potential levels V(−) and V1.

Figure 5:
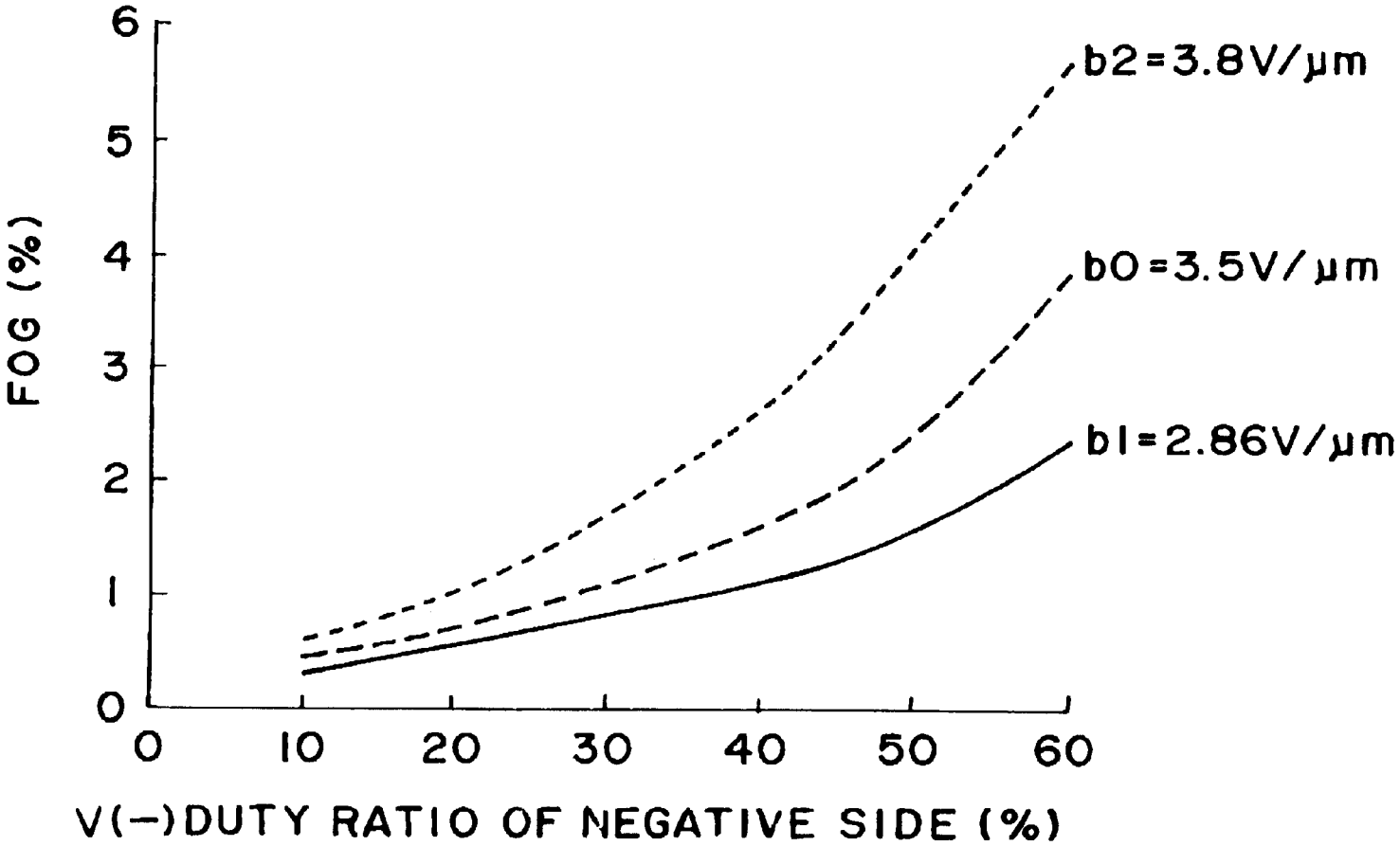
FIG. 5 is a graph which shows the relationship between the duty ratio of the development bias and the amount of the fog, which resulted when the electric field strength between the potential levels V(−) and Vd was used as the parameter in this embodiment.

In the case of the relationship between the potential levels V(−) and Vd, the smaller the electric field strength between them, the better the improvement in terms of the fog level. FIG. 5 shows the relationship between the duty ratio of the development bias and the amount of the fog, which resulted when the electric field strength between the potential levels V(−) and Vd was used as a parameter. The three lines in FIG. 5 represent three different electric field strengths between the potential levels V(−) and Vd: b1=2.86 V/μm (electric field strength in this embodiment); b2=3.8 V/μm; and b0=3.5 V/μm. The electric field strength in the conventional system was |−600−(−1,200)|/280=2.14 V/μm.

As is evident from FIG. 5, in order to keep the amount of the fog at a desirable level, that is, keep it below 3%, while keeping the duty ratio of the development bias, on the V(−) side, between 20%–50%, an arrangement must be made so that the electric field strength between the potential levels V(−) and Vd becomes no more than 3.5 V/μm.

Figure 6:
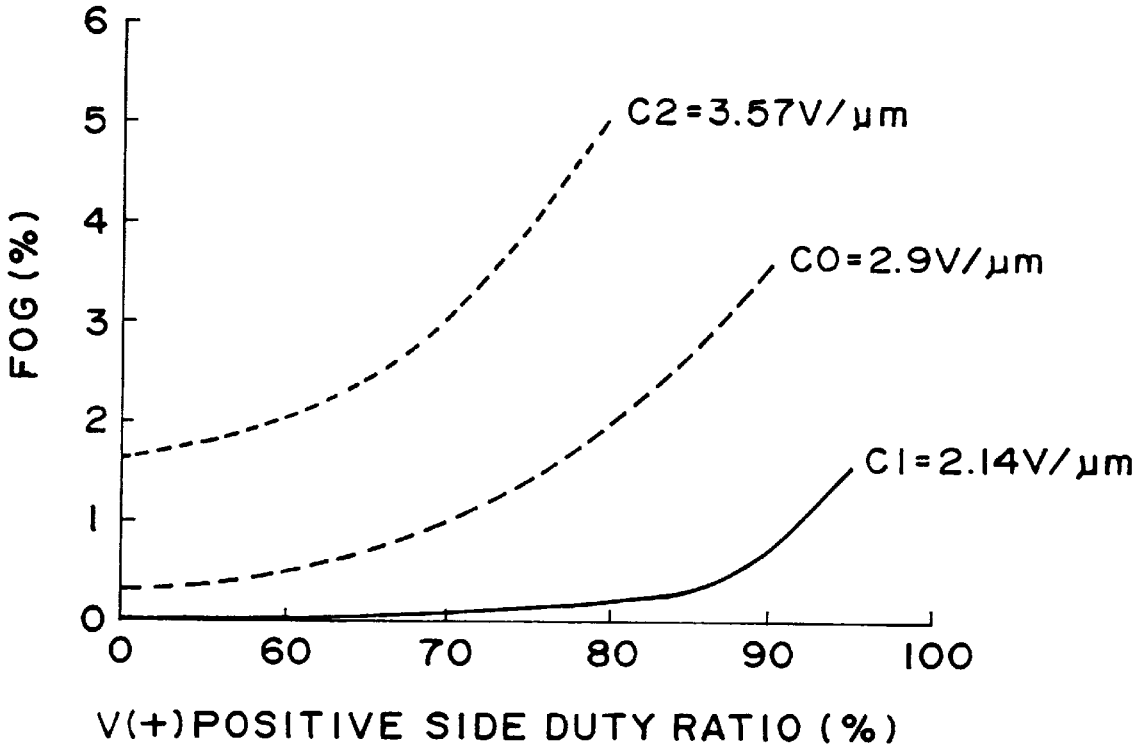
FIG. 6 is a graph which shows the relationship between the duty ratio of the development bias, on the V(+) side, and the amount of the fog, which resulted when the electric field strength between the potential levels V(+) and Vd was used as the parameter in this embodiment.
Figure 7:
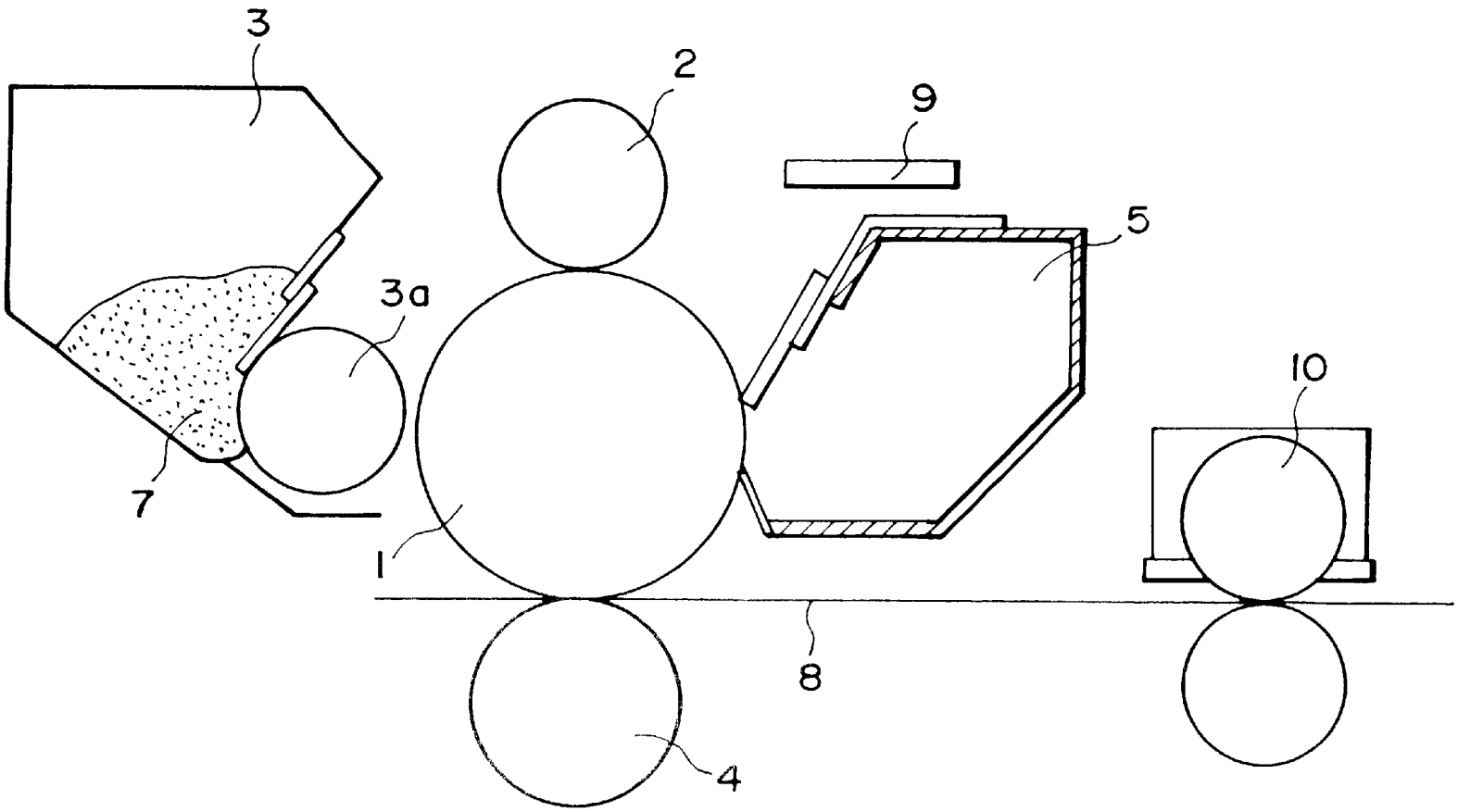
FIG. 7 PRIOR ART
FIG. 7 is a schematic section of a conventional image forming apparatus, and depicts the general structure thereof.
Figure 8:
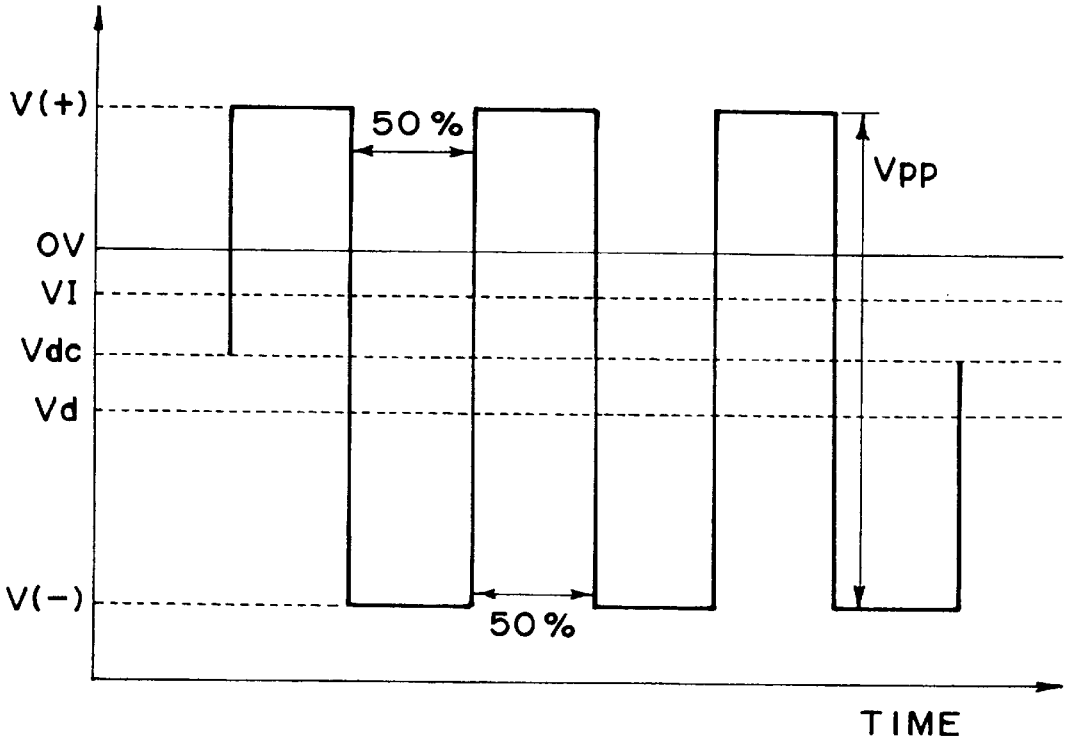
FIG. 8 PRIOR ART
FIG. 8 is a graphic drawing of the wave-form of the development bias employed in the conventional image forming apparatus, showing the potential levels Vd and V1 correspondent to the dark and light portions, respectively.
Figure 9:
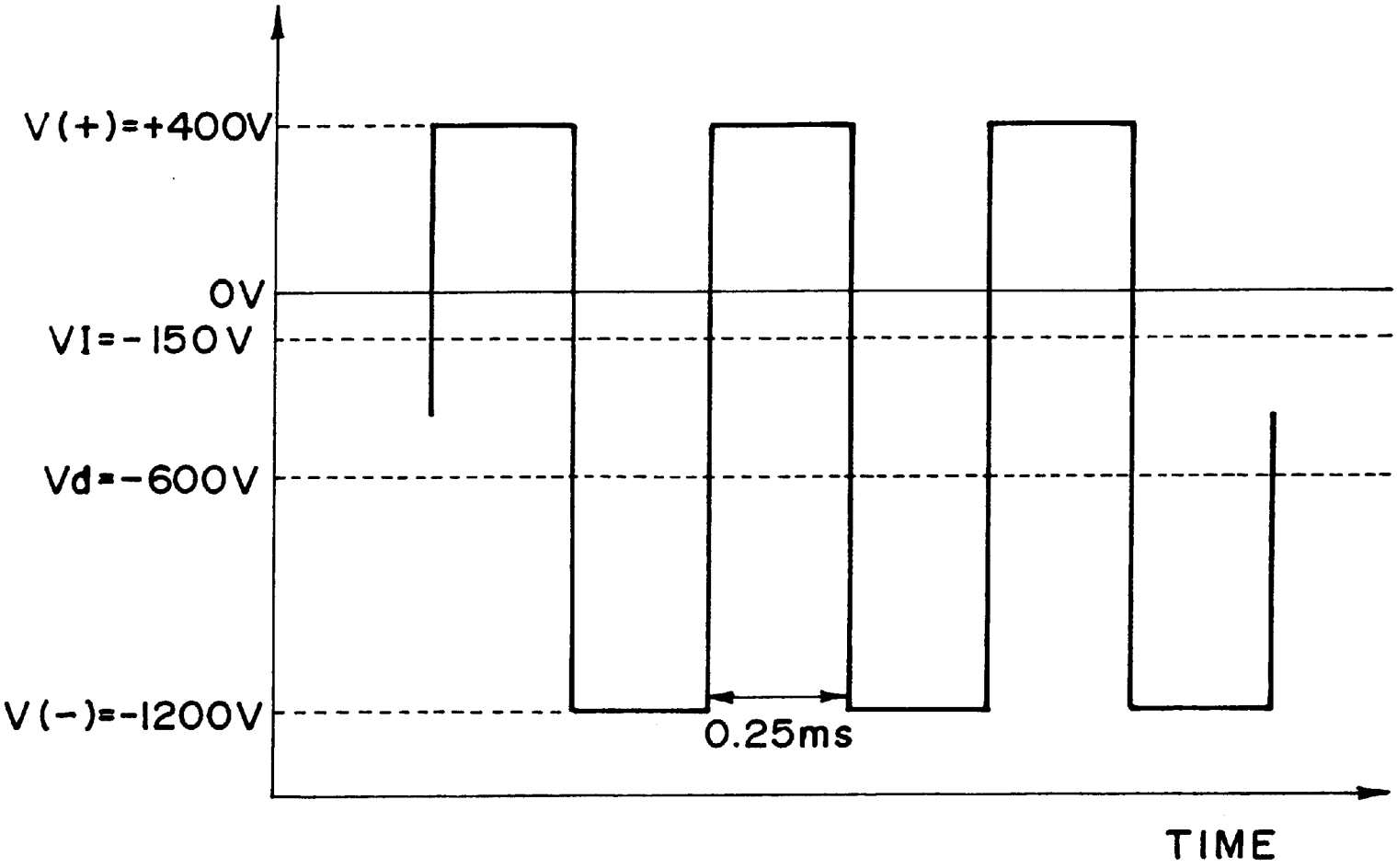
FIG. 9 PRIOR ART
FIG. 9 is a graphic drawing of the wave-form of the development bias employed in the conventional image forming apparatus, showing the potential levels Vd and V1 correspondent to the dark and light portions, respectively.
Figure 10:
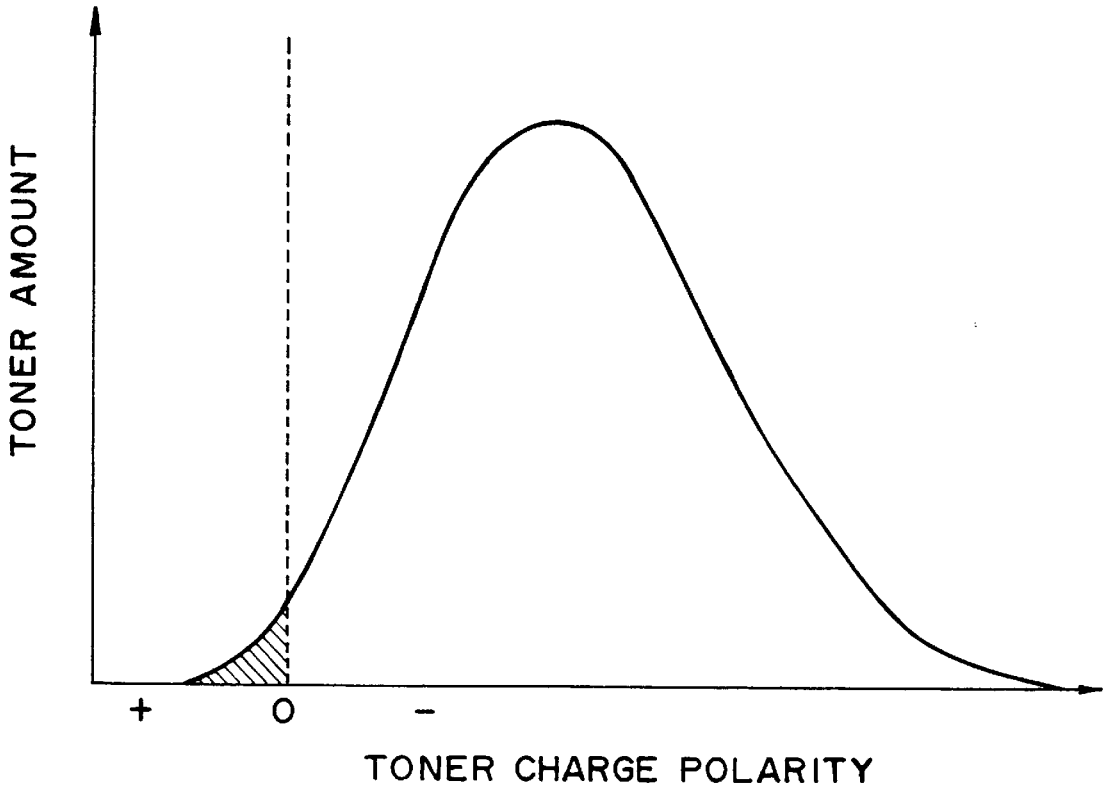
FIG. 10 PRIOR ART
FIG. 10 is a graph which shows the distribution of the toner in terms of polarity and potential level.

In the case of the relationship between the potential levels V(+) and Vd, the smaller the electric field strength between the two, the better the level of the fog. FIG. 6 shows the relationship between the duty ratio of the development bias on the V(+) side and the amount of the fog, which resulted when the electric field strength between the potential levels V(+) and Vd was used as a parameter. The three lines in FIG. 6 represent three different electric field strengths between the potential levels V(+) and Vd: c1=2.14 V/μm (electric field strength in this embodiment); c2=3.57 V/μm (electric field strength in the conventional system: |400−(−600)|/280=3.57); and c0=2.9 V/μm (mid value between c1 and c2).

As is evident from FIG. 6, in order to keep the amount of the fog at a desirable level, that is, keep it below 3%, while keeping the duty ratio of the development bias on the V(−) side between 50%–20% (keeping duty ratio of development bias on V(+) side between 50%–80%), an arrangement must be made so that the electric field strength between the potential levels V(+) and Vd becomes no more than 2.9 V/μm.

As described above, according to the present invention, an image forming apparatus is designed so that the electric field strength between the peak voltage V(−) on the side which causes the toner to jump onto the image bearing member 1, and the image bearing member 1 portions with the light potential level V1 becomes no less than 4.1 V/μm; the electric field strength between the peak value V(−) and the potential level Vd of the dark portions of the image bearing member 1 becomes no more than 3.5 V/μm; and the electric field strength between the peak value V(+) on the side which pulls the toner back onto the development sleeve 3*a* from the image bearing member 1, and the potential level Vd of the dark portions of the image bearing member 1 becomes no more than 2.9 V/μm.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a photosensitive member;

a charging means for charging said photosensitive member to a negative polarity;

exposure means for exposing said photosensitive member charged by said charging means to image light to form an electrostatic image having a dark portion of the negative polarity and a light portion of the negative polarity;

developing means for developing the electrostatic image with a developer which is externally added with strontium titanate, said developing means including a developer carrying member, disposed spaced from said photosensitive member with a gap therebetween, for carrying the developer; wherein said developer carrying member is supplied with a bias voltage which has a substantially rectangular waveform and forms an oscillating electric field between said photosensitive member and said developer carrying member;

wherein an electric field provided by a difference between a jump peak voltage of said bias voltage which is a peak of the voltage for applying, to the developer, force in a direction toward said image bearing member and a potential of said photosensitive member at a portion exposed to the light, is not less than 4.1 V/micron, wherein an electric field provided by a difference between the jump peak voltage and a potential of said photosensitive member at a portion unexposed to the light, is not more than 3.5 V/micron, wherein an electric field provided by a difference between a returning peak voltage of said bias voltage which is a peak of the voltage for applying, to the developer, force in a direction toward said developer carrying member and a potential of said photosensitive member at a portion unexposed to the light, is not more than 2.9 V/micron, and wherein a ratio of a part of the voltage for the direction toward the photosensitive member in the voltage is 20 to 50%.

2. An apparatus according to claim 1, wherein a content of the strontium titanate is not less than 0.5% by wt.

3. An apparatus according to claim 2, wherein a content of the strontium titanate is not more than 3.0% by wt.

4. An apparatus according to claim 1, wherein the developer has a negative charging polarity.

5. An apparatus according to claim 1, wherein the developer is further externally added with silica.

6. An apparatus according to claim 1, wherein an image density of a developed image is changed by changing the ratio.

* * * * *

UNITED STATES PATENT AND TRADEMARK OFFICE

CERTIFICATE OF CORRECTION

PATENT NO. : 6,052,544

DATED : April 18, 2000

INVENTOR(S) : YASUSHI SHIMIZU ET AL.

It is certified that error appears in the above-identified patent and that said Letters Patent is hereby corrected as shown below:

COLUMN 1

Line 37, "in" should read --by--.

COLUMN 2

Line 53, "V1=-150." should read --V1=-150 V.--.

COLUMN 6

Line 53, "2.86 V/$\mu$m," should read --2.86 V/$\mu$m;--.

COLUMN 7

Line 28, "phenomenon:" should read --phenomena:--.

UNITED STATES PATENT AND TRADEMARK OFFICE

CERTIFICATE OF CORRECTION

PATENT NO. : 6,052,544

DATED : April 18, 2000

INVENTOR(S) : YASUSHI SHIMIZU ET AL.

It is certified that error appears in the above-identified patent and that said Letters Patent is hereby corrected as shown below:

COLUMN 8

Line 35, "Jumped" should read --jumped--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*